US010004368B2

(12) United States Patent
Pace

(10) Patent No.: US 10,004,368 B2
(45) Date of Patent: Jun. 26, 2018

(54) SPLASH SHIELD FOR TOILET PLUNGER OR BRUSH

(71) Applicant: John Pace, Atlanta, GA (US)

(72) Inventor: John Pace, Atlanta, GA (US)

( * ) Notice: Subject to any disclaimer, the term of this patent is extended or adjusted under 35 U.S.C. 154(b) by 0 days. days.

(21) Appl. No.: 15/496,231

(22) Filed: Apr. 25, 2017

(65) Prior Publication Data

US 2018/0008105 A1 Jan. 11, 2018

Related U.S. Application Data

(63) Continuation-in-part of application No. PCT/US2016/045275, filed on Aug. 3, 2016.

(60) Provisional application No. 62/360,493, filed on Jul. 11, 2016.

(51) Int. Cl.

| | |
|---|---|
| ***E03D 9/00*** | (2006.01) |
| ***E03D 11/00*** | (2006.01) |
| ***A47K 13/02*** | (2006.01) |
| *E03C 1/304* | (2006.01) |

(52) U.S. Cl.
CPC ..... *A47K 13/02* (2013.01); *E03D 9/00* (2013.01); *E03C 1/304* (2013.01)

(58) Field of Classification Search
CPC ..... A47K 13/02; E03D 9/00
USPC ..... 4/255.11, 300.3
See application file for complete search history.

(56) References Cited

U.S. PATENT DOCUMENTS

| | | | | |
|---|---|---|---|---|
| 4,935,969 | A * | 6/1990 | Farnsworth | A47K 13/16 4/245.4 |
| 5,099,527 | A | 3/1992 | Roose | |
| 5,860,170 | A | 1/1999 | Witt | |
| 6,487,730 | B2 | 12/2002 | Pardo et al. | |
| 7,797,768 | B2 | 9/2010 | St John | |
| 2009/0293185 | A1 | 12/2009 | Falcon et al. | |
| 2010/0000010 | A1 | 7/2010 | Martinisko | |
| 2010/0170030 | A1 | 7/2010 | Haji-Karami-Mahabadi | |
| 2012/0255109 | A1 | 10/2012 | Sciallo et al. | |
| 2012/0318688 | A1 | 12/2012 | Martinisko | |
| 2015/0040302 | A1 | 2/2015 | Cameron et al. | |
| 2015/0060313 | A1 * | 3/2015 | Martinisko | E03D 9/00 206/223 |

* cited by examiner

*Primary Examiner* — Christine Skubinna
(74) *Attorney, Agent, or Firm* — Larry D. Johnson; Paul E. Franz

(57) ABSTRACT

A splash shield for a toilet plunger or brush includes a membrane that fits over the top of a toilet bowl. The membrane seals tightly around the toilet bowl rim and has an aperture proximate the center so the user can slide the plunger or brush handle up through the aperture and affix the edges of the membrane around the toilet bowl, and then plunge or clean the toilet. After use, the user can remove the membrane from the toilet bowl and wrap the contaminated head of the plunger or brush within the membrane and take it away to be cleaned. A new membrane may be placed on the cleaned plunger or brush to act as a sanitary cover until its next use.

18 Claims, 4 Drawing Sheets

SPLASH SHIELD FOR TOILET PLUNGER OR BRUSH

CROSS REFERENCE TO RELATED APPLICATIONS

The present application is a continuation-in-part of PCT International Application No. PCT/US16/45275 filed Aug. 3, 2016, and claims the benefit of the filing date of U.S. Provisional Patent Application Ser. No. 62/360,493, filed Jul. 11, 2016. The foregoing applications are incorporated by reference in their entireties as if fully set forth herein.

TECHNICAL FIELD

This written description relates generally to plumbing supplies and tools, and more particularly to a splash shield for use with a toilet cleaning apparatus such as a toilet plunger or brush.

SUMMARY

Described below is a splash shield for a toilet cleaning apparatus such as a toilet plunger or brush, comprising a protective membrane that fits over the top of any shape toilet bowl (e.g., elongated or round) and that will accommodate any plunger or brush. The membrane seals around the toilet bowl rim and has an aperture proximate the center so the user can slide the plunger or brush handle up through the aperture. Once the handle is slid up through the aperture of the membrane the user can affix the edges of the membrane around the toilet bowl, and can then safely and securely plunge and clear the clog in the toilet or clean the toilet without a drop of sewage waste splashing outside of the toilet bowl. After the user has successfully unclogged or cleaned the toilet, they can remove the membrane from the toilet bowl and wrap the contaminated head of the plunger or brush within the membrane and safely take it away to be cleaned without dripping sewage waste on the floor in route. A new membrane may be placed on the cleaned plunger or brush to act as a sanitary cover until its next use.

Particular embodiments of the subject matter described in this specification can be implemented so as to realize one or more of the following advantages.

The splash shield can fit over the top of multiple different shapes of toilet bowls and will accommodate multiple different plungers or brushes. In some implementations, adhesive material on the bottom side of the splash shield is disposed along the periphery of the splash shield and may adhere to both portions of the top lip of the toilet bowl and the outer sides of the toilet bowl. The peripherally-disposed adhesive material thus enable the splash shield to be securely affixed to a wide variety of toilet bowl shapes and contours. For example, many toilet bowls have front-to-back length (inclusive of the upper lip surface) ranging from 16-20 inches, and a side-to-side width (inclusive of the upper lip surface) of 14-17 inches. However, the splash shield in combination with the adhesive strips being disposed at the outer ranges of these dimensions results in the splash shield being able to be securely affixed to toilet bowls of multiple different dimensions.

A user can safely and securely brush or plunge and clear a clog in a toilet without sewage waste splashing outside of the toilet bowl.

The splash shield enables a user to take a plunger or brush away after use to be cleaned without dripping sewage waste on the floor in route.

The splash shield can be used to provide a sanitary cover for a plunger or brush until its next use.

The details of one or more embodiments of the subject matter described in this specification are set forth in the accompanying drawings and the description below. Other features, aspects, and advantages of the subject matter will become apparent from the description, the drawings, and the claims.

Those skilled in the art will appreciate that the conception upon which this disclosure is based readily may be utilized as a basis for the designing of other structures, methods and systems that include one or more of the various features described below.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

DETAILED DESCRIPTION

Figure 1:
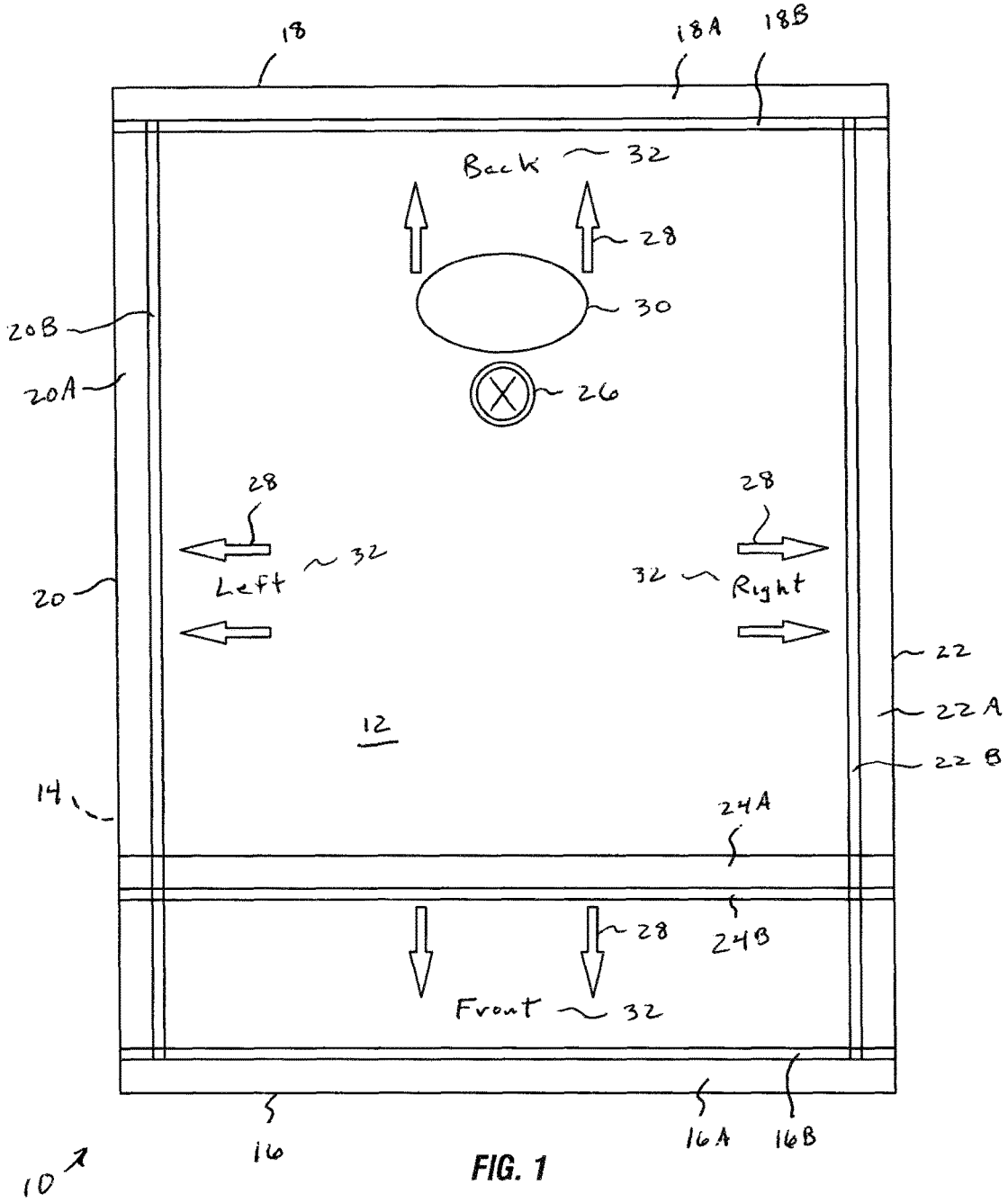
FIG. 1 is a top plan view of a splash shield for toilet cleaning apparatus such as a plunger or brush.

Referring to FIGS. 1 through 4, wherein like reference numerals refer to like components in the various views, there is illustrated therein a splash shield for a toilet cleaning apparatus such as a plunger or brush, generally denominated 10 herein.

FIG. 1 is a top plan view of one implementation of a splash shield 10, including a preferably generally rectangular plastic sheet having a top surface 12 and bottom surface 14, with a front edge 16, back edge 18, left edge 20, and right edge 22. The splash shield may alternately be constructed in any other appropriate shape such as square, round, or elliptical, though a rectangular shape may be preferable for manufacturing efficiencies and ease of installation. Adhesive strip segments 16A, 18A, 20A, and 22A are placed on the bottom surface 14. In some implementations, the placement of the adhesive strip segments 16A, 18A, 20A, and 22A is proximate to edges 16, 18, 20, and 22, respectively. In another implementation, one or more additional adhesive strip segments are placed on the bottom surface. In still another implementation, on or more additional adhesive strip segments are placed adjacent to or concentric with one or more of adhesive strip segments 16A, 18A, 20A, 22A.

The adhesive strip segments 16A, 18A, 20A, and 22A are covered with removable cover strip tape segments 16B, 18B, 20B, and 22B. A medial adhesive strip segment 24A also on the bottom surface extends generally between the left and right edges, and is similarly covered with removable cover strip tape segment 24B. Note: although the adhesive strips and cover strip tape are located on the bottom surface of the shield, they are visible in this FIG. 1 because the plastic sheet is transparent.

An aperture 26 is of a size to permit insertion of and penetration by a plunger or brush handle. In some implementations, the aperture 26 can be reinforced around its perimeter to resist tearing. The aperture 26 may also, in some implementations, be located in an area of the shield 10 so that when the shield 10 is attached to the toilet the plunger is disposed at a preferred angle to facilitate efficient plunging. Indicia such as arrows 28, logo 30, or text 32 may provide orientation guidance to the user for installation of the shield.

Figure 2:
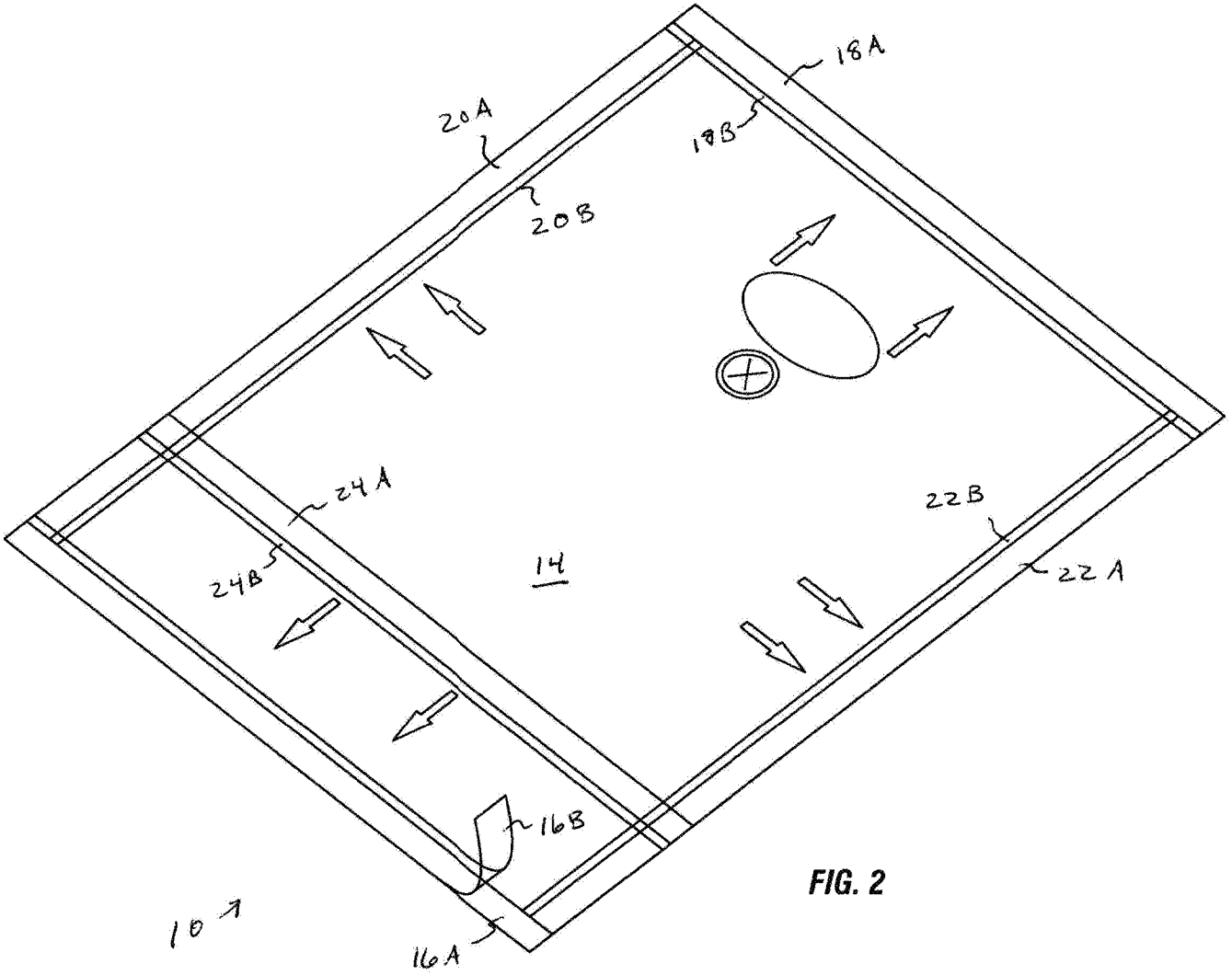
FIG. 2 is a bottom perspective view thereof showing a portion of cover strip tape being removed from over an adhesive strip segment on an edge of the bottom surface of the shield.

FIG. 2 is a bottom perspective view of splash shield 10 showing a portion of cover strip tape 16B being removed from over adhesive strip segment 16A on front edge 16 of the bottom surface 14 of the shield. The cover strip tape 16B is preferably wider than the adhesive strip 16A beneath it, enabling a user to easily reach under and peel off the cover strip tape at any point along the adhesive strip. This view also illustrates that there are preferably four discrete cover strip tape segments 16B, 18B, 20B, 22B along the respective edges, instead of one continuous cover strip tape covering the adhesive strips. This has been found to be advantageous during installation of the splash shield, as described below.

Figure 3:
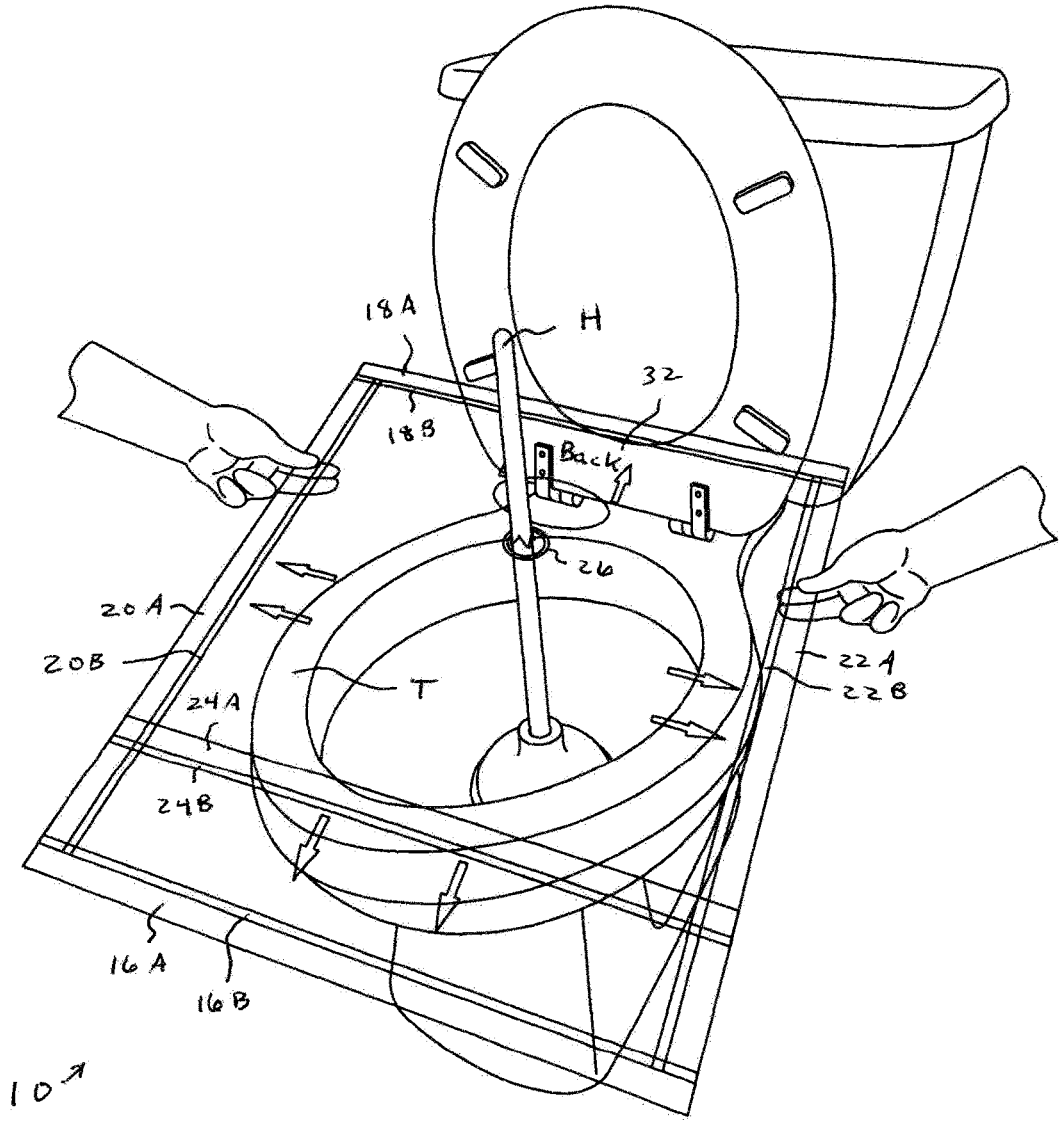
FIG. 3 is a top perspective view of a splash shield placed over a toilet bowl and a plunger that has been placed in the toilet bowl, with the handle of the plunger extending through an aperture of the splash shield.

FIG. 3 is a top perspective view of splash shield 10 placed over an elongated toilet bowl T and the handle H of a plunger that has been placed in the toilet bowl, with the handle H of the plunger extending through the aperture 26 of the splash shield. The size of the splash shield 10 and the location of the adhesive strips 16A, 18A, 20A, and 22A on the bottom surface of the splash shield 10 are preferably such that the edges of the shield span the toilet bowl opening and the adhesive strips secure to the back top and outer sides of the toilet bowl rim. The additional medial adhesive strip 24A and cover strip 24B are utilized when applying the splash shield to a "round" shaped toilet bowl (having a shorter front-to-back length), thus one size of the splash shield fits multiple different styles of toilets.

Because the drain of a standard toilet bowl is typically located proximate the rear of the toilet bowl, and the plunger head should be placed accordingly to form a seal, the aperture 26 is preferably located somewhat back of the center of the membrane, closer to the back edge 18 than the front edge 16. Text 32 or other indicia may be placed near this back edge to guide the user during placement of the splash shield over the toilet.

The cover strip tape segments are preferably removed in the following order to facilitate installation of the splash shield. First, the back edge cover strip tape 18B is removed and the back edge adhesive strip 18A is affixed to the back top and back outer sides of the toilet bowl. Next, the left and right edge cover strip tapes 20B, 22B are removed and the left and right edge adhesive strips 20A, 22A are affixed to the left and right outer sides of the toilet bowl. Finally, front edge cover strip tape 16B is removed and the front edge adhesive strip 16A is affixed to the front outer side of the toilet bowl.

Figure 4:
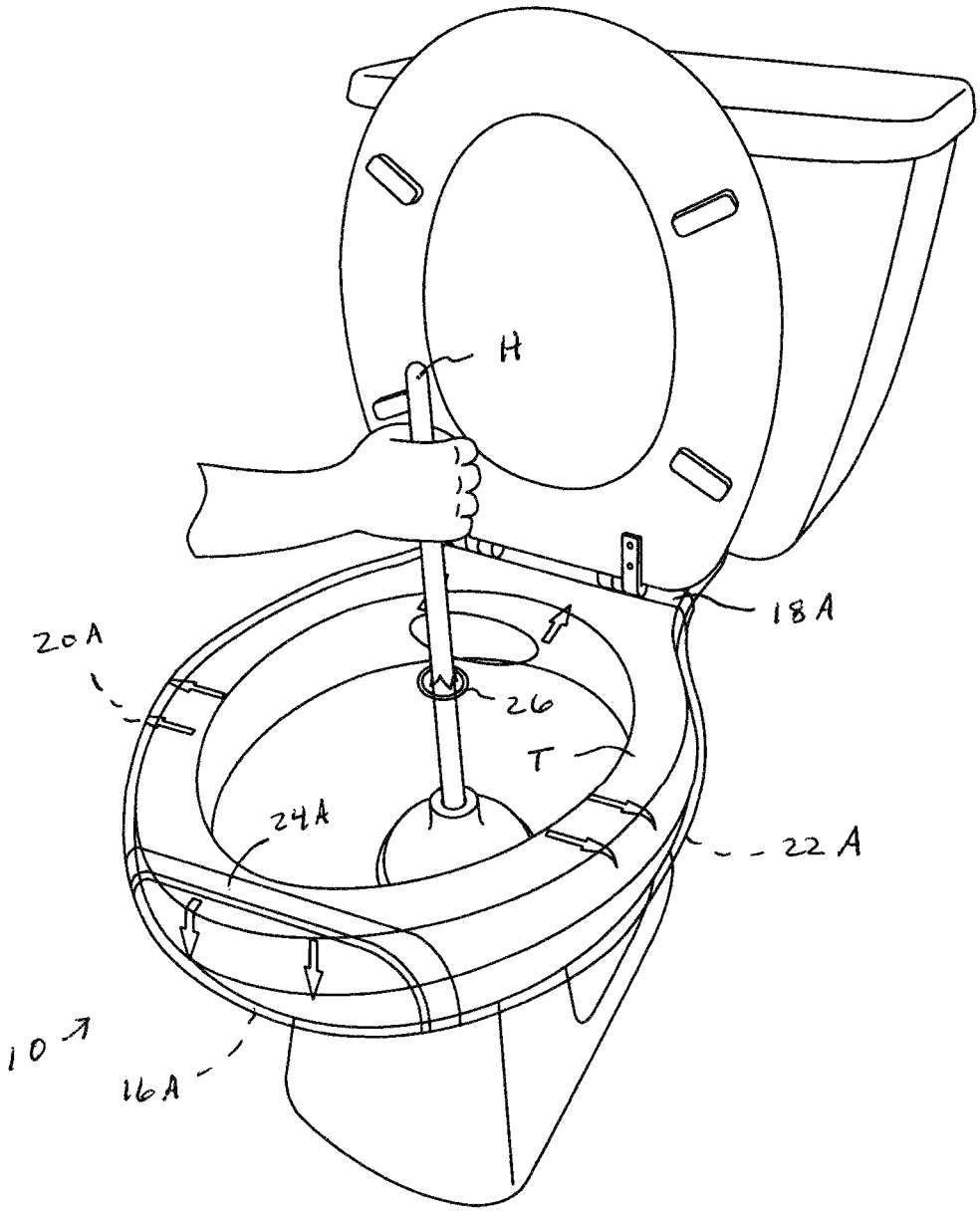
FIG. 4 is a top perspective view of the bottom edges of the shield having been adhered to the toilet bowl, and the plunger handle being manipulated to unclog the toilet.

FIG. 4 is a top perspective view of the adhesive strips 16A, 18A, 20A, 22A of the shield having been adhered to the toilet bowl, and the handle H of the plunger being manipulated to unclog the toilet. Medial adhesive strip 24A is not being used with the elongated-shaped toilet illustrated here, but would be employed with a round shaped toilet. As shown in FIG. 4, adhesive strip 18A adheres to a portion of the top lip of the toilet bowl and the outer sides of the toilet bowl.

The width of the adhesive strips can be any appropriate width to securely affix the splash shield to the toilet bowl. In some implementations, the adhesive strip is approximately one half (½) inches wide around the entire underside perimeter of the rectangular plastic membrane and the removable cover strip tape is preferably approximately one (1) inch wide overtop of the adhesive thus allowing for approximately a one half (½) inch overlap of the cover tape, making it very easy for the user to peel off the cover strip tape at any point along the perimeter of the splash shield and apply the adhesive strip evenly around the toilet bowl. The adhesive is preferably of a type that will stick strong enough to not break the seal loose during and throughout use, however when you do remove it from the toilet bowl it leaves no residue of adhesive where it was stuck to the porcelain bowl. Although the adhesive strip segments are shown to form a continuous strip in the example implementation, in some implementations, the splash shield may have separate adhesive strips along the periphery, e.g., four separate strips, one along each edge, may be used.

Because use of the shield protects the user from both the physical splash back of sewage waste as well as the harmful airborne particles that inherently ascend when agitating a contaminated toilet while both plunging and cleaning, the shield is by nature, anti-microbial in the sense that it physically blocks waste product from coming into contact with the user. The shield may also include an actual anti-microbial resin or other material incorporated into the plastic membrane for further protection from bacteria, germs and viruses such as *Salmonella, E. coli*, C-Diff and Hepatitis C, etc. The shield may also include a pleasant smelling odor guard or fragrance that makes the job of cleaning and plunging a contaminated toilet a better experience.

A new splash shield may be placed over a plunger or brush handle and used as a sanitary cover between uses, by wrapping the plastic cover over the head of the plunger or brush. A portion of cover strip tape may be peeled back or removed from one or more edges to expose adhesive to aid in securing the new shield in place. Alternatively, one or more of the cover strip tape segments may include perforations or cuts to enable removal of only a portion of the cover strip tape, or a separate patch of covered adhesive may be provided on the splash shield itself.

The shield may be constructed from any appropriate material, and in the example implementation is constructed of a 4 m gauge see-through plastic that reduces the tendency to tear during rigorous plunging or cleaning. Other materials may also be used, and the materials may also be opaque, such as paper, for example. The shield may include the instructions for use actually printed on some portion of the shield. Typical instructions may include some or all of the following for one example implementation of the shield:

Instructions for Use:

For cleaning your toilet: Prior to beginning the toilet cleaning process pour a liberal amount of cleaning disinfectant inside your toilet bowl. Then proceed with steps 1-3 below using your toilet brush. Once you have successfully cleaned and disinfected your toilet bowl, peel back each of the four sides of your splash shield off the toilet bowl and slide the used splash shield back off the toilet brush handle and dispose of it in the trash.

For plunging your toilet: Please refer to steps 1-3 below. Once the blockage is successfully unclogged, flush your toilet once or twice then peel back just a portion of the front of your splash shield allowing enough space for you to pour a liberal amount of your favorite cleaning disinfectant inside your toilet bowl. Re-attach the front of your splash shield to the outer front portion of your toilet and begin to agitate your plunger around the toilet bowl to ultimately disinfect and clean your plunger, your toilet bowl and the underside soiled portion of your used splash shield. You can then peel back your splash shield from each side and dispose of it in the trash. Alternately depending on preference; once the blockage is successfully unclogged, flush your toilet once or twice then peel back each side of your used splash shield and slide it back off the plunger handle and dispose of it in the trash. Then you can pour a liberal amount of cleaning disinfectant into your toilet bowl and carefully stir your plunger around to disinfect your plunger and toilet bowl. Carefully, shake off any excess water then remove your plunger from inside your toilet. Slide a new splash shield over the top of your plunger handle thus making it ready for its next use.

Step 1: Lift your toilet seat into the upright position. Next, place your toilet brush or plunger inside the bowl with head down and handle upright. Slide your splash shield down the handle of your toilet brush or plunger through the designated hole. Note: In many cases, it will serve best to first slide your splash shield over the top of your plunger handle before placing your plunger head inside your toilet bowl. Position the splash shield logo to make sure the red arrows that say, "This End Back", are pointed towards the back of your toilet.

Step 2: Next, reach underneath the backside of your splash shield and grab the overlapping tape and peel back exposing the adhesive strip. Stick the back side of your splash shield evenly to the back of your toilet bowl rim using the exposed adhesive strip.

Step 3: Reach underneath both sides of the splash shield and peel back the overlapping tape, exposing the adhesive strips. Stick the exposed adhesive strips evenly to the sides of the toilet. Lastly, peel back the front overlapping tape, then stick the exposed adhesive strip evenly to the front side of the toilet, creating an all-around seal.

If Plunging: Evenly place the plunger head on top of the drain creating a seal, then flush toilet and thrust the plunger head downwards a few times until clog clears. When you flush a clogged toilet while using a splash shield the air pocket between the toilet fluid and the splash shield creates added pressure allowing you to successfully unclog your toilet in a fraction of the time that it used to take.

Note: In many cases depending on how much fluid is inside your toilet bowl it will serve best to first slide the splash shield over the top of the plunger handle through the designated hole before placing your plunger head inside your toilet bowl. This is especially true if your toilet is clogged with waste water near the top of your toilet bowl rim. After sliding the splash shield down over your plunger handle, please proceed with steps 2 and 3 above.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A splash shield for a toilet cleaning apparatus, the splash shield comprising:

a sheet having a top surface and a bottom surface, a front edge, back edge, left edge, and right edge that define an outer periphery;

one or more peripheral adhesive strips on the bottom surface proximate to the front, back, left, and right edges;

a medial adhesive strip on the bottom surface separate from and disposed between peripheral adhesive strips proximate to the front and back edges and extending between peripheral adhesive strips proximate to the left and right edges;

one or more removable cover strip tapes covering the one or more peripheral adhesive strips and the medial adhesive strip; and an aperture in the sheet operable to receive a handle of a cleaning apparatus, wherein:

the one or more peripheral adhesive strips are peripherally disposed within the outer periphery on the bottom of the sheet and the medial adhesive strip is disposed toward the front edge of the sheet and separate from the peripheral adhesive strip that is proximate to the front edge of the sheet so that when at least some of the one or more cover strip tapes are removed the sheet may be adhesively affixed to a toilet of at least two different sizes and at least two or more of the peripheral adhesive strips and the medial adhesive strip adheres to at least the outer sides of the toilet bowl that are below a top surface lip of the toilet bowl to adhere at least portions of two or more of the front edge, back edge, left edge, right edge, and a portion to which the medial adhesive strip is attached to the outer sides of the toilet bowl that are below a top surface lip of the toilet bowl.

2. The splash shield of claim 1, wherein at least one of the one or more adhesive strips adheres to both portions of a top lip surface of the toilet bowl and the outsides of the toilet bowl.

3. The splash shield of claim 2, wherein the splash shield is plastic.

4. The splash shield of claim 1 wherein the sheet is rectangular in shape.

5. The splash shield of claim 1 wherein the removable cover strip comprises discrete segments covering the adhesive strip on the front edge, back edge, left edge, and right edge.

6. The splash shield of claim 1 wherein the aperture is reinforced around a perimeter thereof to resist tearing.

7. The splash shield of claim 1 wherein the aperture is located closer to the back edge than the front edge.

8. The splash shield of claim 1 further including indicia to provide orientation guidance to a user for installation of the splash shield.

9. The splash shield of claim 1 wherein the removable cover strip is wider than the adhesive strip to facilitate removal.

10. A splash shield for a toilet cleaning apparatus, the splash shield comprising:

a sheet having a top surface and a bottom surface, a front edge, back edge, left edge, and right edge that define an outer periphery;

one or more peripheral adhesive strips on the bottom surface proximate to the front edge, back edge, left edge, and right edge;

a medial adhesive strip on the bottom surface disposed between a peripheral adhesive strip proximate to the front edge and a peripheral adhesive strip proximate to the back edge, and spanning the bottom surface of the sheet between a peripheral adhesive strip proximate to the left edge and a peripheral adhesive strip proximate to the right edge;

one or more removable cover strip tapes covering the one or more peripheral adhesive strips and the medial adhesive strip; and an aperture in the sheet operable to receive a handle of a cleaning apparatus, wherein:

the one or more peripheral adhesive strips are peripherally disposed within the outer periphery on the bottom of the sheet and the medial adhesive strip is disposed toward the front edge of the sheet and separate from the peripheral adhesive strip that is proximate to the front edge of the sheet so that when at least some of the one or more cover strip tapes are removed the sheet may be adhesively affixed to a toilet of at least two different sizes and at least two or more of the peripheral adhesive strips and the medial adhesive strip adheres to at least the outer sides of the toilet bowl that are below a top surface lip of the toilet bowl to adhere at least portions of two or more of the front edge, back edge, left edge, right edge, and a portion to which the medial adhesive strip is attached to the outer sides of the toilet bowl that are below a top surface lip of the toilet bowl.

11. The splash shield of claim 10, wherein at least one of the one or more adhesive strips adheres to both portions of a top lip surface of the toilet bowl and the outsides of the toilet bowl.

12. The splash shield of claim 10, wherein the splash shield is plastic.

13. The splash shield of claim 10 wherein the sheet is rectangular in shape.

14. The splash shield of claim 10 wherein the removable cover strip comprises discrete segments covering the adhesive strip on the front edge, back edge, left edge, and right edge.

15. A splash shield for a toilet cleaning apparatus, the splash shield comprising:

a sheet having a top surface and a bottom surface, a front edge, back edge, left edge, and right edge that define an outer periphery;

a peripheral adhesive strip on the bottom surface proximate to the front edge, the back edge, the left edge, and the right edge;

a medial adhesive strip on the bottom surface offset from the peripheral adhesive strips proximate the front and back edges and extending between the peripheral adhesive strips proximate the left and right edges;

one or more removable cover strip tapes covering the one or more peripheral adhesive strips and the medial adhesive strip; and an aperture in the sheet operable to receive a handle of a cleaning apparatus, wherein:

the peripheral adhesive strips are peripherally disposed within the outer periphery on the bottom of the sheet and the medial adhesive strip is disposed toward the front edge of the sheet and separate from the peripheral adhesive strip that is proximate to the front edge of the sheet so that when at least some of the one or more cover strip tapes are removed the sheet may be adhesively affixed to a toilet of at least two different sizes, the peripheral adhesive strips proximate to the left edge and right edge adhere to the outer sides of the toilet bowl, at least one of the peripheral adhesive strip proximate to the front edge and the medial adhesive strip adheres to the outer front side of the toilet bowl, and the peripheral adhesive strip proximate to the back edge adheres to a top surface lip of the toilet bowl.

16. The splash shield of claim 15, wherein the splash shield is plastic.

17. The splash shield of claim 15 wherein the sheet is rectangular in shape.

18. The splash shield of claim 1 wherein the removable cover strip comprises discrete segments covering the adhesive strip on the front edge, back edge, left edge, and right edge.

* * * * *